US006647568B2

(12) United States Patent
Bentley

(10) Patent No.: US 6,647,568 B2
(45) **Date of Patent: *Nov. 18, 2003**

(54) TUB WITH FOOT-ACTUATED HANDLE AND VALVE WITH INVERTIBLE PORT PLATE FOR MOUNTING HANDLE AT DIFFERENT ORIENTATIONS WITHIN THE TUB

(76) Inventor: Samuel Bayne Bentley, 80 S. Market St., 2nd Floor, San Jose, CA (US) 95113

( * ) Notice: Subject to any disclaimer, the term of this patent is extended or adjusted under 35 U.S.C. 154(b) by 0 days.

This patent is subject to a terminal disclaimer.

(21) Appl. No.: 10/269,334

(22) Filed: Oct. 11, 2002

(65) Prior Publication Data

US 2003/0159210 A1 Aug. 28, 2003

Related U.S. Application Data

(63) Continuation-in-part of application No. 10/082,439, filed on Feb. 22, 2002.

(51) Int. Cl.[7] ..... E03C 1/04
(52) U.S. Cl. ..... 4/675; 4/676; 4/677; 251/295
(58) Field of Search ..... 4/675, 559, 676, 4/677; 16/360, 376; 251/295

(56) References Cited

U.S. PATENT DOCUMENTS

| | | | | | |
|---|---|---|---|---|---|
| 1,432,916 | A | | 10/1922 | Schwartz | |
| 2,010,791 | A | | 8/1935 | Sakier | 4/173 |
| D143,100 | S | | 12/1945 | Stanitz | D91/3 |
| 2,444,340 | A | * | 6/1948 | Donahue | 4/680 |
| D157,312 | S | | 2/1950 | Young | D4/3 |
| D159,311 | S | | 7/1950 | Arculrius | D91/3 |
| D187,096 | S | | 1/1960 | Young | D91/3 |
| D191,191 | S | | 8/1961 | Kawolics | D91/3 |
| 3,465,379 | A | | 9/1969 | Forte | 16/110 |
| 3,493,978 | A | * | 2/1970 | Hindman | 4/694 |
| 4,514,868 | A | | 5/1985 | Visinand | 4/541 |
| 4,706,311 | A | | 11/1987 | Jarosinski | 4/546 |
| 4,729,135 | A | | 3/1988 | Titterington | 4/597 |
| D434,475 | S | | 11/2000 | Meda | D23/252 |
| D434,476 | S | | 11/2000 | Meda | D23/252 |
| 6,145,140 | A | | 11/2000 | Fernie et al. | 4/577.1 |
| 6,220,266 | B1 | | 4/2001 | Hennessy | 137/1 |
| D450,808 | S | | 11/2001 | Gottwald | D23/250 |

* cited by examiner

*Primary Examiner*—John Rivell
*Assistant Examiner*—Azy Kokabi
(74) *Attorney, Agent, or Firm*—Thomas Schneck; David M. Schneck; Nissa Strottman

(57) ABSTRACT

A handle for controlling water temperature and/or water flow is mounted on the side of a bathtub and shaped such that the handle may be controlled by a bather's foot. The vanes of the handle are shaped to accommodate the shape of the foot and are spaced apart from each other to allow easy operation of the handle. An invertible port plate in the valve is provided for mounting the handle in both right sidewall and left sidewall versions.

28 Claims, 5 Drawing Sheets

TUB WITH FOOT-ACTUATED HANDLE AND VALVE WITH INVERTIBLE PORT PLATE FOR MOUNTING HANDLE AT DIFFERENT ORIENTATIONS WITHIN THE TUB

CROSS-REFERENCE TO RELATED APPLICATION

This application is a continuation-in-part of pending U.S. application Ser. No. 10/082,439, filed Feb. 22, 2002.

FIELD OF THE INVENTION

This invention relates to a bath fixture, particularly a bathtub with a mechanism for controlling the temperature of water entering the bath.

BACKGROUND OF THE INVENTION

Bathtubs and faucet handles are well-known in the prior art. The "traditional" bathtub features a faucet with handles at the opposite end of the tub from the bather's head. The faucet handles are almost always located immediately next to the faucet; all of these faucets are meant to be operated by hand.

This arrangement is not convenient for the bather soaking in the tub while water enters the tub or for the elderly or handicapped bather. The configuration discussed above requires the bather to shift around in the tub to operate the faucet handles. While this is an annoyance to many people, it is uncomfortable and even dangerous to the elderly, the handicapped, or those suffering from a chronic condition or injury such as arthritis or back pain. Another problem with this configuration is that those whose use of their hands is limited, due to arthritis, for instance, may be unable to manipulate the handles, which generally require the user to close their fingers over the handle, with their hands.

While the prior art does contain numerous patents which disclose devices to assist the handicapped or elderly person's safety and mobility while bathing, most of the prior art discusses a bathtub with handles for controlling water temperature and flow that have to be operated by hand in the usual way. A bathtub equipped with other options for water control would benefit the elderly and handicapped by giving them greater independence and control over their bathing environment. This bathtub would also benefit bathers who are neither elderly or handicapped.

It is an object of this invention to provide a bathtub with a mechanism for controlling water temperature and/or water flow that is not controlled by a user's hand.

SUMMARY OF THE INVENTION

The above object has been met with a handle for controlling water temperature and/or water flow that is mounted on a valve placed on a wall of a bathtub and is shaped such that the handle may be controlled by a bather's foot. In one embodiment, the handle has three convex vanes radiating from a central pivot axis. The handles are asymmetrically spaced apart from each other at angles that will allow a bather's foot to easily manipulate the handle. In one embodiment, the handle can control both water temperature and water flow. In another embodiment, two handles, one to control water temperature and one to control water flow, may be installed in the tub. In yet another embodiment, the handle may be mounted in the bathtub with a shower fixture such that the handle may be manipulated by the foot of someone taking a bath and by the hand of someone taking a shower. An invertible port plate in the valve allows the handle to be mounted on left and right sidewall versions of the tub so that the symmetry of handle rotation is preserved. In one embodiment, the handle is attached at its pivot axis by a handle mounting. The bather can use one of the bather's feet to engage the handle tabs and turn the handle.

DETAILED DESCRIPTION OF THE INVENTION

Figure 1A:
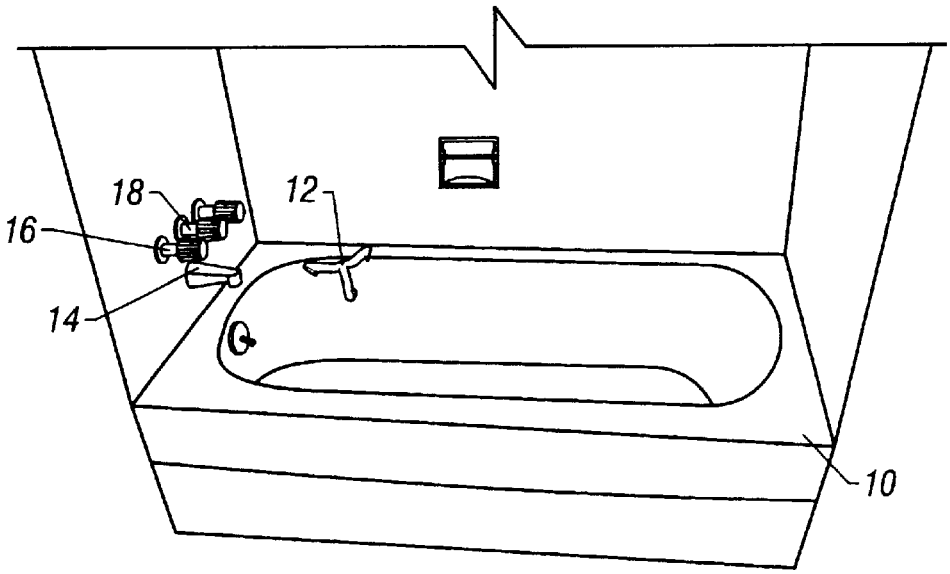
FIG. 1*a* is view of a bathtub with a foot-actuated handle in accordance with the invention.

FIG. 1*a* shows a bathtub 10 with a foot-actuated handle 12. The bathtub 10 may be of any shape and may be free-standing or constructed such that the bathtub and the adjacent wall(s) are a single unit. In addition to the foot-actuated handle 12, the bathtub 10 is also equipped with a faucet 14 and hand-operated handles for controlling water temperature 16 and shower 18. In other embodiments, the foot-actuated handle 12 may be mounted anywhere the bathtub 10, depending on the tub's 10 shape and orientation; neither the hand-operated handles 16 or shower 18 need be present. The handle 12 may control temperature, water flow, or both temperature and water flow.

Figure 1B:
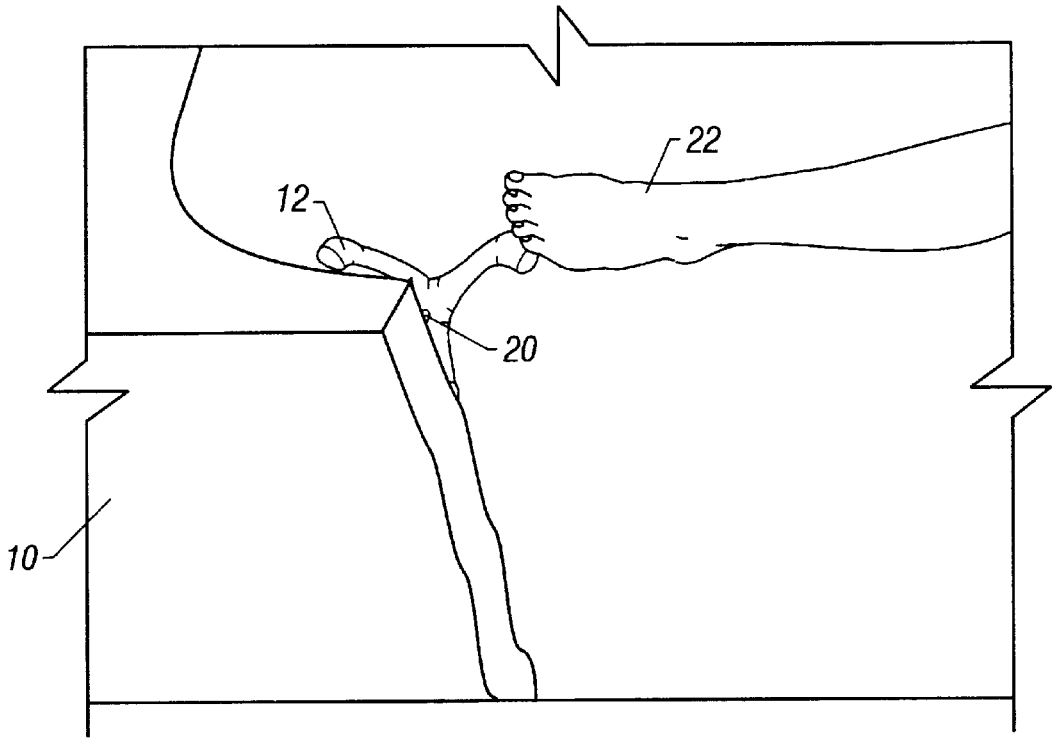
FIG. 1*b* is a cutaway view of the bathtub with a foot-actuated handle being operated by a bather's foot.

FIG. 1*b* shows how the foot-actuated handle 12 is operated by a bather's foot 22. In this embodiment, the handle 12 is mounted on a standard valve 20 on a sidewall of the bathtub 10. (The handle 12 is shown here on a different sidewall of the bathtub 10 than was shown in FIG. 1*a* for purposes of clarity of illustration. As noted above, the handle 12 may be mounted anywhere in the bathtub 10. Depending on where the handle 12 is mounted the valve 20 may require non-standard threading in order to rotate in the appropriate direction. However, this should be clear to someone skilled in the art.) The bather's outstretched foot 22 can manipulate the handle 12 to adjust the temperature and/or flow of water entering the bath. As shown here (and discussed in greater detail below in FIG. 3), the vanes of the handle 12 are structured such that the handle 12 may be easily operated to adjust the temperature and/or flow of water into the bathtub. While this figure shows the handle 12 being operated by the ball of the bather's foot 22, the handle may also be operated by the toes or heel of the foot 22.

Figure 3:
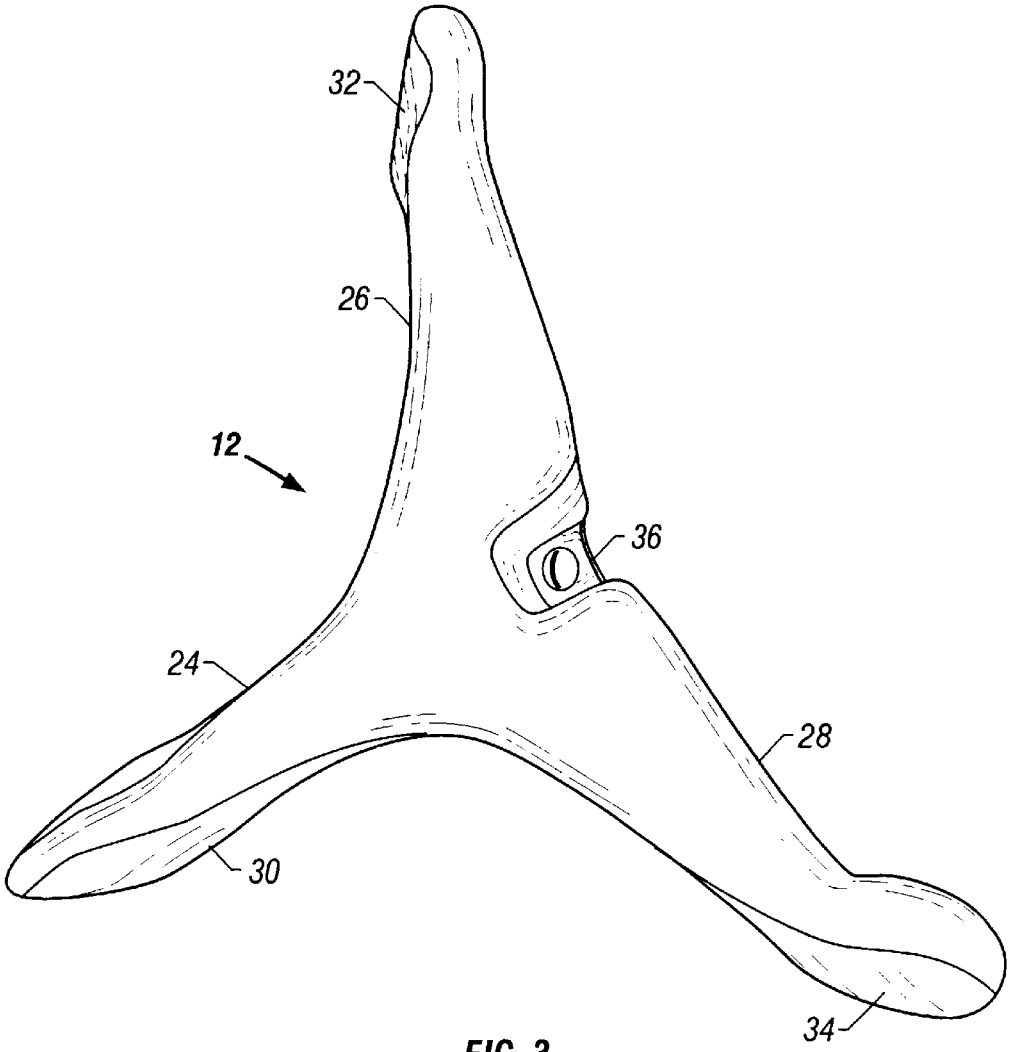
FIG. 3 is another overhead view of the handle shown in FIG. 1*a*.

With respect to FIG. 3, the handle 12 has three vanes 24, 26, 28. The handle 12 is mounted on a pivot axis 36 attached to a standard valve (see FIG. 1*b*). At the end of each of the vanes 24, 26, 28 is a tab 30, 32, 34. The tabs 30, 32, 34 allow the bather's foot to gain more purchase on the handle 12 and thus turn the handle 12. The vanes 24, 26, 28 are asymmetrically spaced around the handle's 12 pivot axis 36 - in this case the "central" vane 24 is 105 degrees apart from the other two vanes 26, 28, which are 150 degrees apart from each other. The vanes 24, 26, 28 of the handle 12 may be separated by different angles in other embodiments. For instance, in other embodiments, two of the vanes 26, 28 are each between 95 and 115 degrees apart from the third vane 24, while the two vanes 26, 28 are separated from each other by an angle between 130 and 170 degrees.

Figure 2:
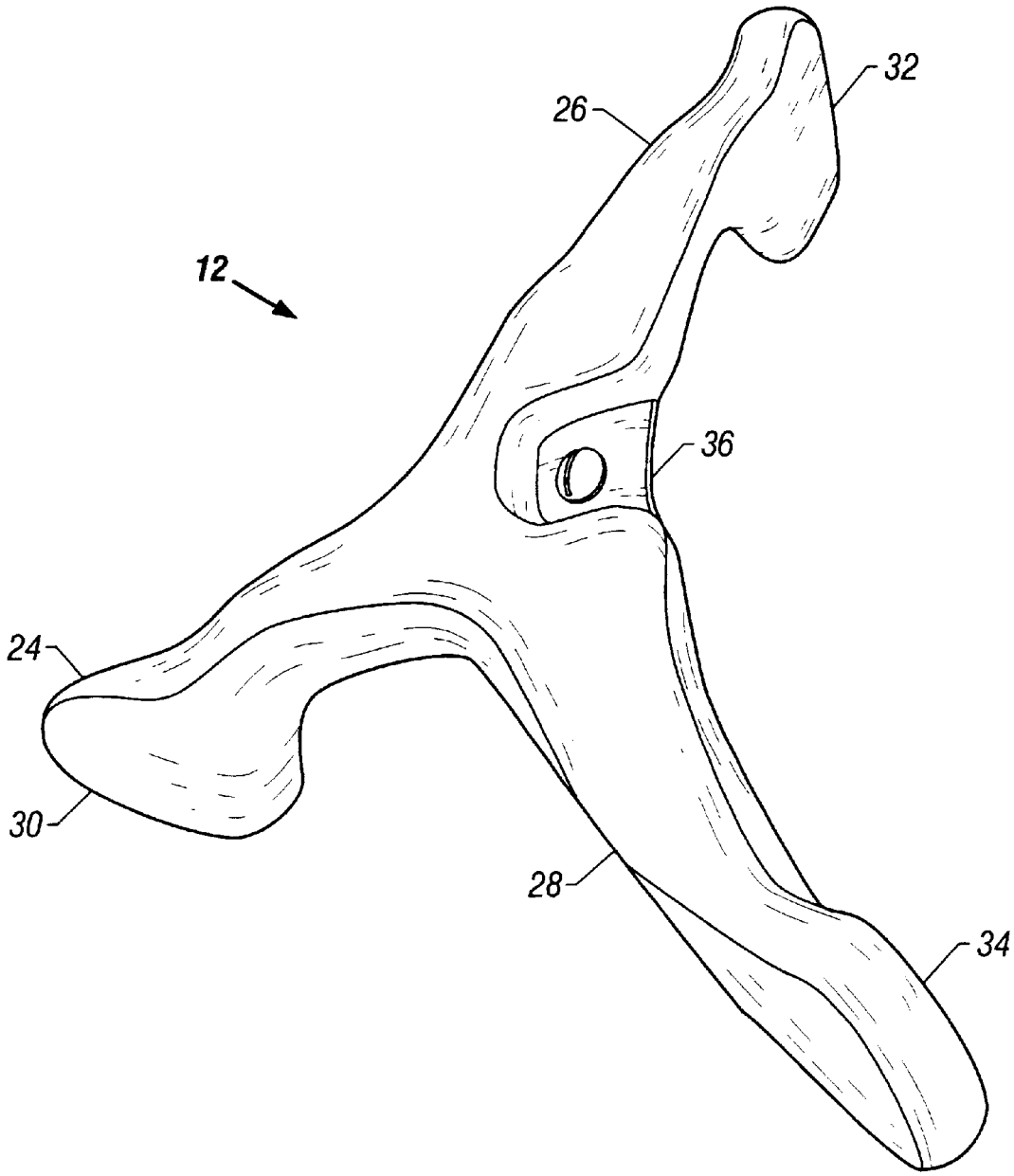
FIG. 2 is an overhead view of the handle shown in FIG. 1*a*.
Figure 4:
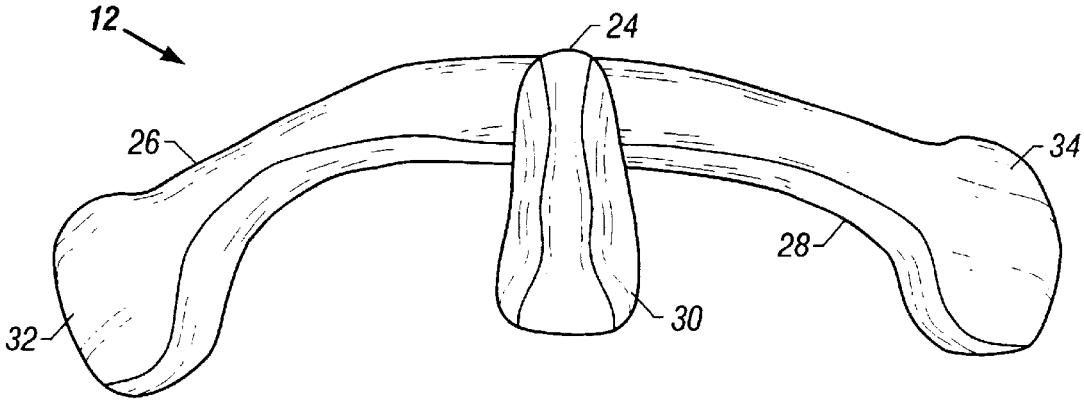
FIG. 4 is a side view of the handle shown in FIG. 1*a*.

With reference to FIGS. 2, 3, and 4, in this embodiment the tab 30 at the end of the central vane 24 has more of a wedge shape than the other two tabs 32, 34, which are flatter. The wedge shape allows the central vane 24 to present the same angle to the bather whether the handle 12 is in an active position (water entering the tub) or an inactive position (no water entering the tub). In other embodiments, all three tabs may have the same shape.

As shown in FIG. 4, the handle's 12 vanes 24, 26, 28 are arcuately shaped, giving the handle 12 a dome-like appearance. The vanes 24, 26, 28 are shaped to accommodate the shape of the foot; this allows the bather greater control and comfort when manipulating the handle 12.

Each vane 24, 26, 28 is at least 4 inches long and at least ½ inch wide. The tabs 30, 32, 34 are each at least 2 inches wide.

In another embodiment, the handle can be placed in a bathtub/shower unit such that it may be operated by the foot of a bather or the hand of someone taking a shower. The handle's vanes are large enough to ensure that even someone who lacks fine motor control in his or her hands can operate the handle, for example with a fist, an outstretched hand, or even the lower arm.

In yet another embodiment, the bathtub may contain two handles that may be operated by foot. One of these handles may control water flow while the other controls the temperature (i.e., mixing of hot and cold water supplies) of the water entering the tub. Alternatively, one handle may control the flow of hot water while the other controls the flow of cold water.

Since tubs are made in both right sidewall and left sidewall versions, means are provided for mounting the handle in two different orientations, the symmetry of the handle orientation in the "OFF" position being preserved.

Figure 5:
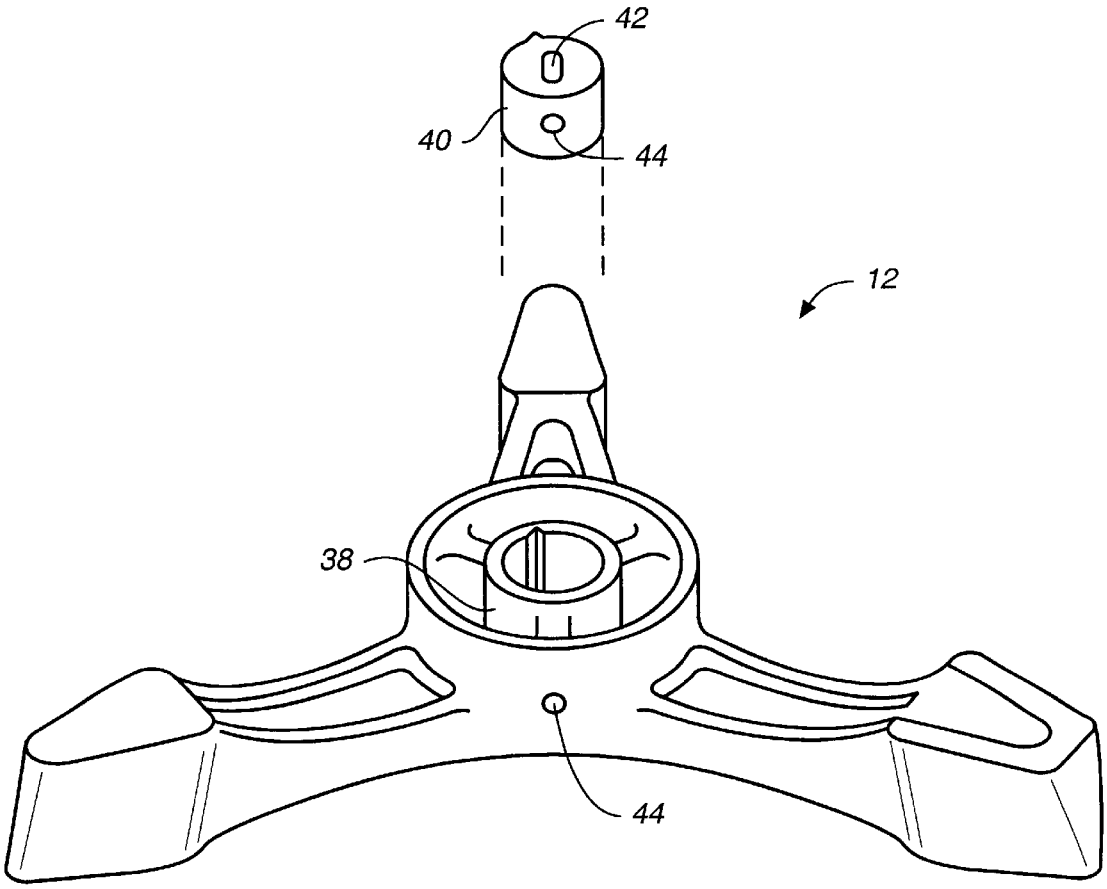
FIG. 5 is a view of the underside of the handle, including the mounting hub and reversible plug, shown in FIG. 1*a*.

With reference to FIG. 5, the handle 12 has a mounting hub 38. A reversible plug 40 is keyed to the hub 38 so that upon inverting the plug 40, the oblong slot 42 that receives the valve stem (see FIG. 1B, item 20) is presented at a different angle from the non-inverted position. Referring again to FIG. 5, the plug 40 further has one hole through which passes, axially, without threading, the set screw 44 in the hub bringing the set screw 44 into contact with the valve stem. The hub 38 has, further, one additional set screw 44 which passes axially through the hub 38 and comes into contact with the plug 40, maintaining the plug 40 securely in the hub 38.

As noted above, when going from right sidewall to left sidewall mounting, the valve itself must be operated in reversed rotation, if, for either mounting, the foot motion to turn on the valve is to be a forward pressure against the top most vane of the handle, while pushing forward on the lower-most vane turns the valve off. Although different motions to turn the valve may be employed in other embodiments, the configuration detailed above is preferred for safety reasons.

Figure 6:
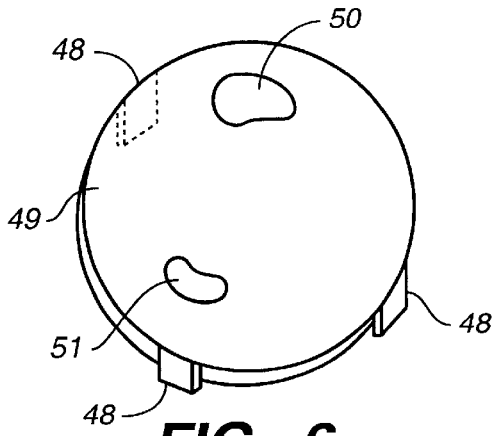
FIG. 6 is a view of the internal port plate of a standard valve, with conventional mounting tabs.
Figure 7:
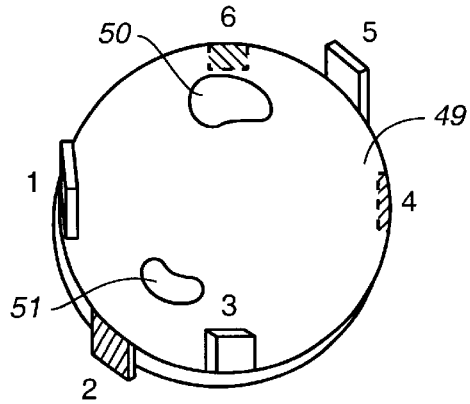
FIG. 7 is a view of the improved internal port plate showing the double set of mounting tabs.

Given these concerns, the valve itself must be made reversible. Commercially available single rotation valves have an internal flat port plate 49 shown in FIG. 6 with two lobe-shaped ports 50, 51 that abut the hot and cold inlet valve seats (shown below in FIGS. 8 and 9), and between two and four mounting tabs 48 projecting perpendicularly on one side of the plate 49. In FIG. 7, the desired reversibility can be achieved by providing the port plate 49 with six mounting tabs 6, three of which project perpendicularly on one side of the plate 49 and three on the opposite side. The six tabs 1–6 altogether are positioned around the generally circular periphery of the port plate 49 with inversion symmetry. That is, the three "up" tabs 1, 3, 5 and the three "down" tabs 2, 4, 6 exchange positions upon inverting the plate 49, so that they will occupy the same set of three mounting slots in the valve body. The positions of the tabs 1–6 are such that, upon inverting the port plate 49, the two lobe shaped ports 50, 51 stand in the same geometric relation to the valve inlet seats as before the inversion, but with the reversed rotational sense.

The valve body must be rotated to its opposite extreme of rotation in the normally "OFF" position, typically 270 degrees, though this may vary among commercially-available valves. In order to have symmetry between left or right sidewall mounting of the valve, the desired positioning of the mounting tabs 1–6 in one embodiment is achieved with the geometry shown in FIG. 8, in which the reflection axis RX 62 is at an angle of 135 degrees with the horizontal axis passing though the hot-cold inlet centers 54.

Figure 8:
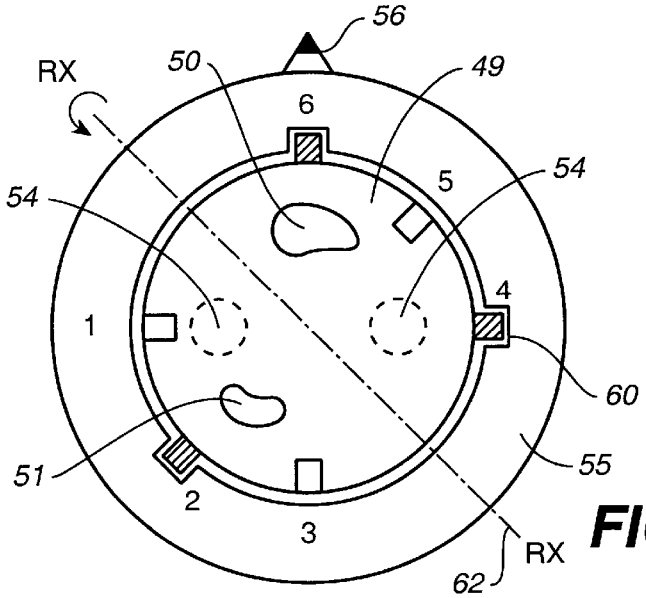
FIG. 8 shows the port plate and valve body with mounting tabs for counter-clockwise valve rotation in accordance with the invention.

In FIG. 8 the mounting tabs 2, 4, 6 are shaded to indicate their perpendicular projection below the port plate 49, even though shown as outward radial projections. Tabs 2, 4, 6 thus engage mounting slots 60 in the valve body 55, constraining the port plate 49 to rotate with the valve body 55.

In contrast, mounting tabs 1, 3, and 5, shown as unshaded inward radial projections, are actually perpendicular projections above the port plate 49, and are not engaged by mounting slots 60 in the view shown.

Figure 9:
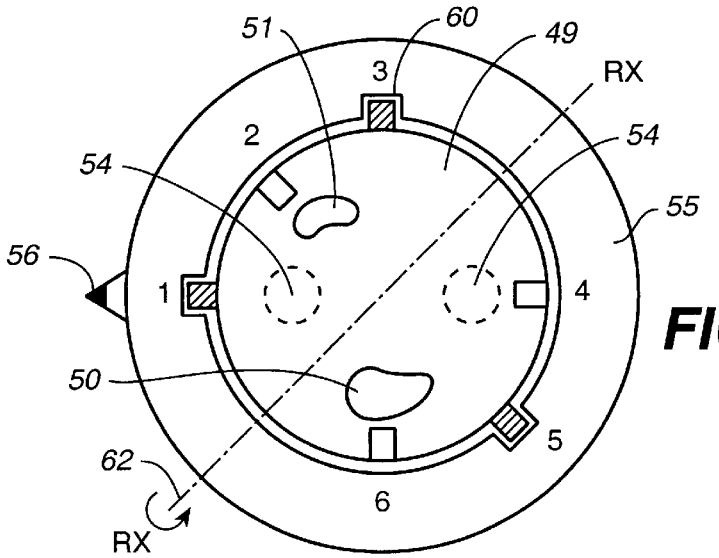
FIG. 9 shows the inverted port plate and valve body with mounting tabs for clockwise valve rotation in accordance with the invention.

As shown in FIG. 9, upon inverting the port plate 49 around the axis RX 62, the mounting tabs 1, 3, 5 engage the slots in the valve body 55, exchanging positions with tabs 6, 4 and 2, respectively. As in FIG. 8, the "down" tabs are shown as shaded.

Referring again to FIG. 9, the inversion has been performed and, in addition, the valve body 55 has been rotated counterclockwise by 90 degrees, as indicated by comparing the triangular markers 56 on the periphery of both FIGS. 8 and 9.

In both FIGS. 8 and 9, the inlet ports 54 belong to the stationary valve housing and are indicated by dashed circles, and remain stationary during rotation of the valve body 55.

With the inversion performed as shown in FIG. 9, the rotation of the valve port plate 49 with respect to the inlet port valve seats 54 is preserved with reversed rotational symmetry, from the opposite extreme of rotation, as desired.

Alternatively, instead of a single port plate with two sets of mounting tabs that is inverted to achieve reversibility of operation, as described above, the same result can be achieved by providing two port plates with each valve purchased by the end-user. The plates would be mirror images of each other with respect to the shape and positions of the two inlet apertures; the positions of the mounting tabs would be chosen to yield the correct geometric relationship of the apertures to the stationary inlet ports. The installer of the valve would then select the correct plate for the particular installation.

Other commercially available single rotation valves with other internal design than a flat port plate can be suitably adapted for reversibility.

What is claimed is:

1. A bath fixture comprising:

a) a bathtub of a size accommodating a seated adult bather having outstretched legs and feet;

b) a handle for controlling temperature of water entering the bathtub from a water supply spout, said handle having a plurality of vanes spaced about a pivot axis, each of the plurality of vanes having a tab at a terminal end of the vane opposite from the pivot axis;

c) a valve on a sidewall of the bathtub, wherein said handle is attached at its pivot axis to the valve by a handle mounting, wherein said foot of said bather can engage one of the handle tabs and turn the handle so as to effect a change of the temperature of the water entering the bathtub.

2. The bath fixture of claim 1 wherein the valve has an internal port plate having six mounting tabs perpendicular to the surface of the port plate, said six mounting tabs located on the periphery of the port plate.

3. The bath fixture of claim 2 wherein three of the six mounting tabs are facing in an upward direction from the surface of the port plate.

4. The bath fixture of claim 3 wherein three of the six mounting tabs are facing in a downward direction from the surface of the port plate.

5. The bath fixture of claim 4 wherein the mounting tabs are spaced about the periphery of the port plate such that either side of the port plate may be used for rotational operation of the valve.

6. The bath fixture of claim 5 wherein the rotation of the valve is clockwise.

7. The bath fixture of claim 5 wherein the rotation of the valve is counter-clockwise.

8. The bath fixture of claim 1 wherein the handle mounting has a hub fitted with a reversible plug, said reversible plug allowing the handle to be mounted on a sidewall in one of two orientations, wherein the orientation determines position of the handle in an off position.

9. The bath fixture of claim 8 wherein the reversible plug has an oblong slot for receiving the valve stem, said slot receiving the valve stem in a different position when the reversible plug is inverted than when the plug is not inverted.

10. The bath fixture of claim 1 wherein the handle has three vanes.

11. The bath fixture of claim 1 wherein the handle also controls flow of water into the bathtub.

12. The bath fixture of claim 1 wherein the vanes of the handle are convex.

13. A bathtub faucet handle assembly suitable for mounting on a bathtub sidewall, said handle comprising:

a) a handle for controlling temperature of water entering a bathtub from a water supply spout, said handle having a plurality of vanes spaced about a pivot axis, each of the plurality of vanes having a tab at a terminal end of the vane opposite from the pivot axis, wherein a foot of a bather sitting in the bathtub can engage one of the handle tabs and turn the handle so as to effect a change the temperature of the water entering the bathtub;

b) a handle mounting for attaching the handle at the pivot axis to a valve on a sidewall of the bathtub, wherein the handle mounting has a hub fitted with a reversible plug, said reversible plug allowing the handle to be mounted on a sidewall in one of two orientations, wherein the orientation determines position of the handle in an off position.

14. The bathtub faucet handle assembly of claim 13 wherein the reversible plug has an oblong slot for receiving the valve stem, said slot receiving the valve stem in a different position when the reversible plug is inverted than when the plug is not inverted.

15. The bathtub faucet handle assembly of claim 13 wherein the handle has three vanes.

16. The bathtub faucet handle assembly of claim 13 wherein the handle also controls flow of water into the bathtub.

17. The bathtub faucet handle assembly of claim 13 wherein the vanes of the handle are convex.

18. In a bath fixture having a bathtub of a size accommodating a seated adult bather having outstretched legs and feet, an improved faucet handle assembly comprising:

a) a handle for controlling temperature of water entering the bathtub from a water supply spout, said handle having three vanes spaced about a pivot axis, each of the plurality of vanes having a tab at a terminal end of the vane opposite from the pivot axis, wherein said foot of said bather can engage one of the handle tabs and turn the handle so as to effect a change the temperature of the water entering the bathtub;

c) a valve on a sidewall of the bathtub, wherein said valve has an internal port plate having a plurality of mounting tabs for engaging the valve body, said tabs spaced about the periphery of the port plate such that either side of the port plate may be used to enable rotational operation of the valve; and d) a handle mounting for attaching the handle at the pivot axis to the valve, wherein the handle mounting has a hub fitted with a reversible plug, said reversible plug allowing the handle to be mounted on a sidewall of the bathtub in one of two orientations, wherein the orientation determines position of the handle in an off position.

19. The improvement of claim 18 wherein the reversible plug has an oblong slot for receiving the valve stem, said slot receiving the valve stem in a different position when the reversible plug is inverted than when the plug is not inverted.

20. The improvement of claim 18 wherein three of the six mounting tabs on the valve's internal port plate face in an upward direction from the surface of the port plate.

21. The improvement of claim 20 wherein three of the six mounting tabs on the valve's internal port plate face in a downward direction from the surface of the port plate.

22. The improvement of claim 21 wherein the mounting tabs are spaced about the periphery of the port plate such that either side of the port plate may be used for rotational operation of the valve.

23. The improvement of claim 22 wherein the rotation of the valve is clockwise.

24. The improvement of claim 21 wherein the rotation of the valve is counter-clockwise.

25. The improvement of claim 18 wherein the handle mounting has a hub fitted with a reversible plug, said reversible plug allowing the handle to be mounted on a sidewall in one of two orientations, wherein the orientation determines position of the handle in an off position.

26. The improvement of claim 25 wherein the reversible plug has an oblong slot for receiving the valve stem, said slot receiving the valve stem in a different position when the reversible plug is inverted than when the plug is not inverted.

27. The improvement of claim 18 wherein the handle also controls flow of water into the bathtub.

28. The improvement of claim 18 wherein the vanes of the handle are convex.

* * * * *

UNITED STATES PATENT AND TRADEMARK OFFICE

CERTIFICATE OF CORRECTION

PATENT NO. : 6,647,568 B2
DATED : November 18, 2003
INVENTOR(S) : Samuel Bayne Bentley It is certified that error appears in the above-identified patent and that said Letters Patent is hereby corrected as shown below:

Column 6,
Line 51, "The improvement of claim 21 wherein the rotation of" should read:
-- The improvement of claim 22 wherein the rotation of --.

Signed and Sealed this

Twenty-third Day of November, 2004

JON W. DUDAS
*Director of the United States Patent and Trademark Office*